United States Patent [19]

Beede

[11] 4,334,991

[45] Jun. 15, 1982

[54] BAFFLES FOR SEPTIC TANK PORTS

[76] Inventor: Earl R. Beede, R.F.D. #3, Concord, N.H. 03301

[21] Appl. No.: 207,956

[22] Filed: Nov. 18, 1980

Related U.S. Application Data

[63] Continuation of Ser. No. 47,758, Jun. 12, 1979, abandoned.

[51] Int. Cl.[3] ..... B01D 21/24

[52] U.S. Cl. ..... 210/232; 210/532.2

[58] Field of Search ..... 210/170, 232, 237, 319, 210/320, 322, 474, 532.2, 519, 542, 137

[56] References Cited

U.S. PATENT DOCUMENTS

| | | | |
|---|---|---|---|
| 1,115,016 | 10/1914 | Pheils | 210/542 |
| 1,168,544 | 1/1916 | Newlin | 210/474 X |
| 1,889,601 | 11/1932 | Heinkel | 210/532.2 |
| 2,482,870 | 9/1949 | Price | 210/542 |
| 3,097,166 | 7/1963 | Monson | 210/170 |
| 3,221,881 | 12/1965 | Weiler et al. | 210/532.2 |
| 3,591,009 | 7/1971 | Luthi | 210/137 |
| 3,826,376 | 7/1974 | Carlson et al. | 210/519 |

OTHER PUBLICATIONS

Modern Concrete, 7/1979, Del Zotto Mfg. Advertisement.

*Primary Examiner*—John Adee

[57] ABSTRACT

Baffles for septic tank ports are of a plastic stock that is inert with respect to reagents commonly existing in them. Each baffle is so dimensioned that its side edges engage the interior surfaces of the tank on opposite sides of incoming or exiting flow paths and is provided with laterally projecting resilient flanges spaced inwardly of the side edges and when seated against and secured to interior surfaces of the tank they maintain the side edges in linear contact with the interior of the tank. Each baffle is also provided at its upper end with hangers adjacent its side edges that extend over the top of a tank and become anchored in mortar when the tank cover is in place.

10 Claims, 5 Drawing Figures

IN
OUT
12
13
11
14
15
16
17
10

19A
19
20
18
11
16
12
23
21A
22
21
16B
16C
10

21
19A
23
19
16
16C
20
16B
18
16A
12
16C
19
16B
20
19A
23
21
10

BAFFLES FOR SEPTIC TANK PORTS

This is a continuation of application Ser. No. 047,758, filed June 12, 1979, now abandoned.

BACKGROUND REFERENCE

U.S. Pat. No. 3,591,009.

BACKGROUND OF THE INVENTION

Baffles are required for the inlet and outlet ports of septic tanks. These are secured to the tank interiors and the requirements are that, in addition to controlling flow, they be light in weight and capable of being easily and securely installed. Concrete baffles in general meet such requirements except that it has proved difficult to establish and maintain the side edges of such baffles in such engagement with the interior of the tanks as to prevent lateral flow that the baffles are required to block. Concrete baffles have a tendency to deteriorate or become damaged with age and are heavy and often damaged during transit or while being installed.

THE PRESENT INVENTION

The general objective of the present invention is to provide baffles of a plastic construction that overcomes the problem of effecting and maintaining adequate linear engagement of the side edges of the baffles with the interiors of septic tanks whether circular or rectangular.

In accordance with the invention, this objective is attained with a plastic baffle, the plastic inert with respect to reagents normally found in septic tanks and dimensioned to extend downwardly from the top of the tank below either the path of entering or exiting flows with side edges engageable with the interior of the tank to block lateral flow. Each baffle includes anchoring means in the form of anchoring flanges each of which projects laterally in a plane parallel to the appropriate one of the side edges but spaced inwardly therefrom. Each anchoring flange is sufficiently resilient to ensure that when seated against and secured to the tank interior, the adjacent side edge is securely seated against the tank interior to prevent unwanted lateral flow.

Each baffle also includes plastic hangers secured to its upper end adjacent the side edges and of a length to extend over the top of the tank and to be locked in place in the mortar added to the top of the installed tank before it is closed by its cover.

BRIEF DESCRIPTION OF THE DRAWINGS

The accompanying drawings illustrate preferred embodiments of the invention of which.

THE PREFERRED EMBODIMENTS OF THE INVENTION

Figure 1:
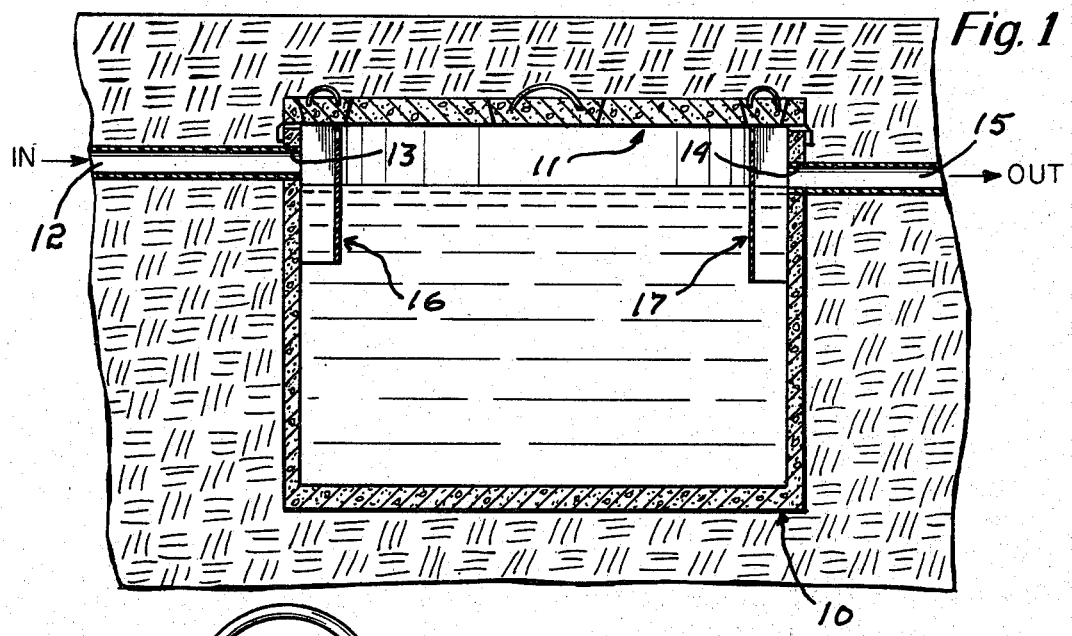
FIG. 1 is a vertical section of an installed septic tank equipped with baffles in accordance with the invention.
Figure 2:
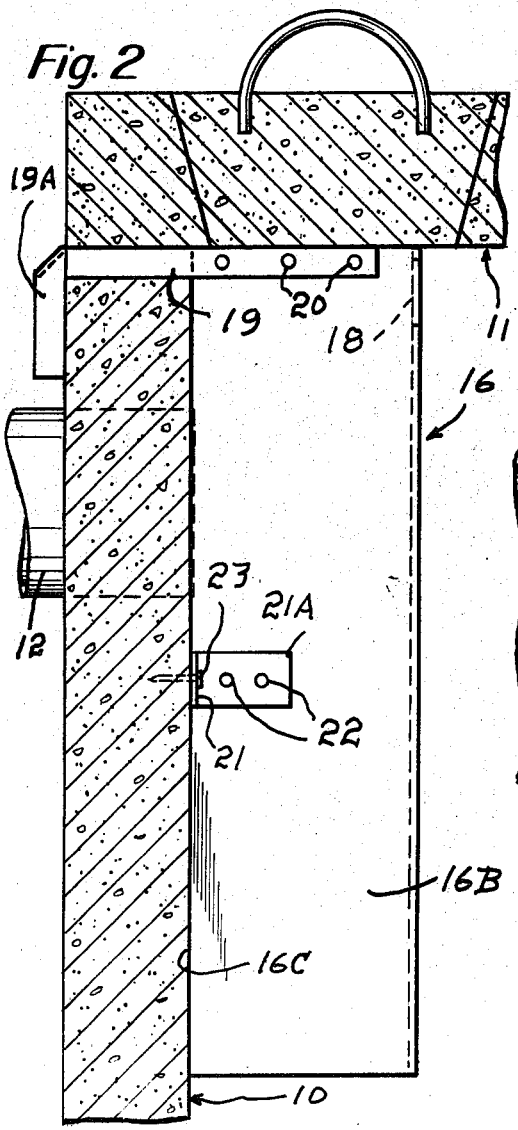
FIG. 2 is a side view, or an increase in scale, of the left hand baffle of FIG. 1.

In FIG. 1, an installed conventional circular septic tank is generally indicated at 10 with its cover similarly indicated at 11. The pipe 12 from a house is entrant of the tank port 13 above the liquid level in the tank 10 established by the port 14 which receives an end of the pipe 15 disposed to discharge effluent into the leach bed, not shown.

The inlet port 13 and the outlet port 14 are provided with baffles generally indicated at 16 and 17, respectively. As the baffles 16 and 17 are identical except that they may, as shown, differ as to length, only the baffle 16 is detailed. The length of the baffles is determined by the area and depth of the septic tank in which they are to be installed and, by way of example, with a typical one thousand gallon tank, the baffle 16 may be twenty-five inches in length and the baffle 17 three inches longer.

The baffles 16 and 17 are U-shaped and of a selected length and each has a port 18 adjacent the upper end of its central or back wall 16A and with its side walls 16B diverging somewhat. The function of the port 18 of each baffle is to ensure that a venting path exists across the tank 10 from the leach bed to the vent pipe in the house. The baffles may be an extrusion and the plastic is polypropylene or the equivalent. A wall thickness in the order of one-eighth of an inch has proved to be satisfactory.

At the upper ends of each baffle wall 16A there is a hanger 19 consisting of a strip, preferably also of polypropylene or the equivalent, secured thereto by non-corrosive rivets 20 and dimensioned to extend across the tank wall with its outer end 19A folded to provide a hook. The hangers 19 serve to hold a baffle in position while being secured as well as to hold its upper end in place.

Figure 3:
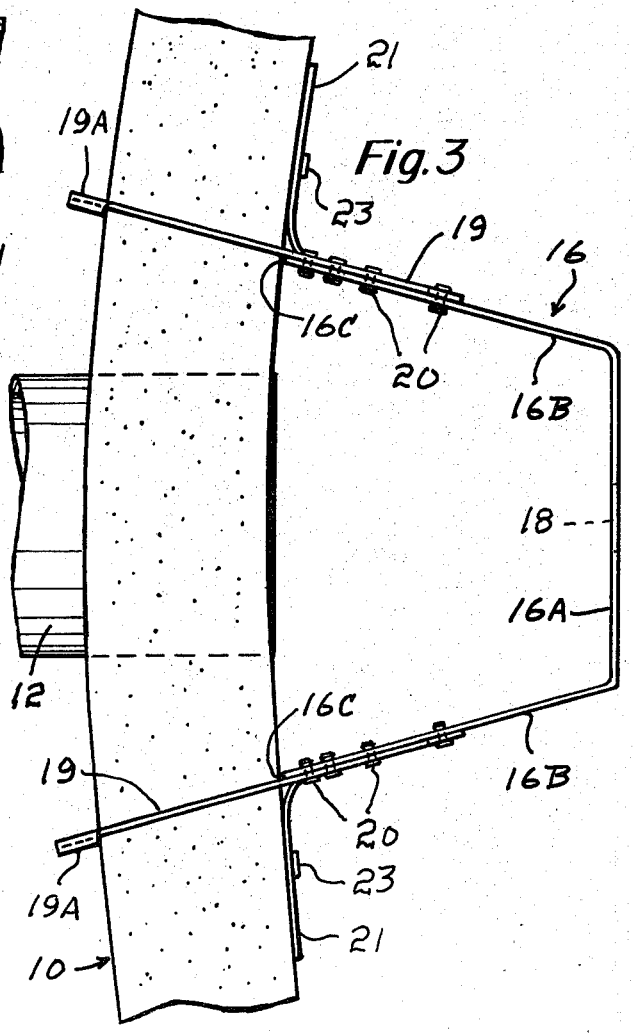
FIG. 3 is a view, on a further increase in scale, of the baffle of FIG. 2 as seen before the cover is placed on the tank.
Figure 4:
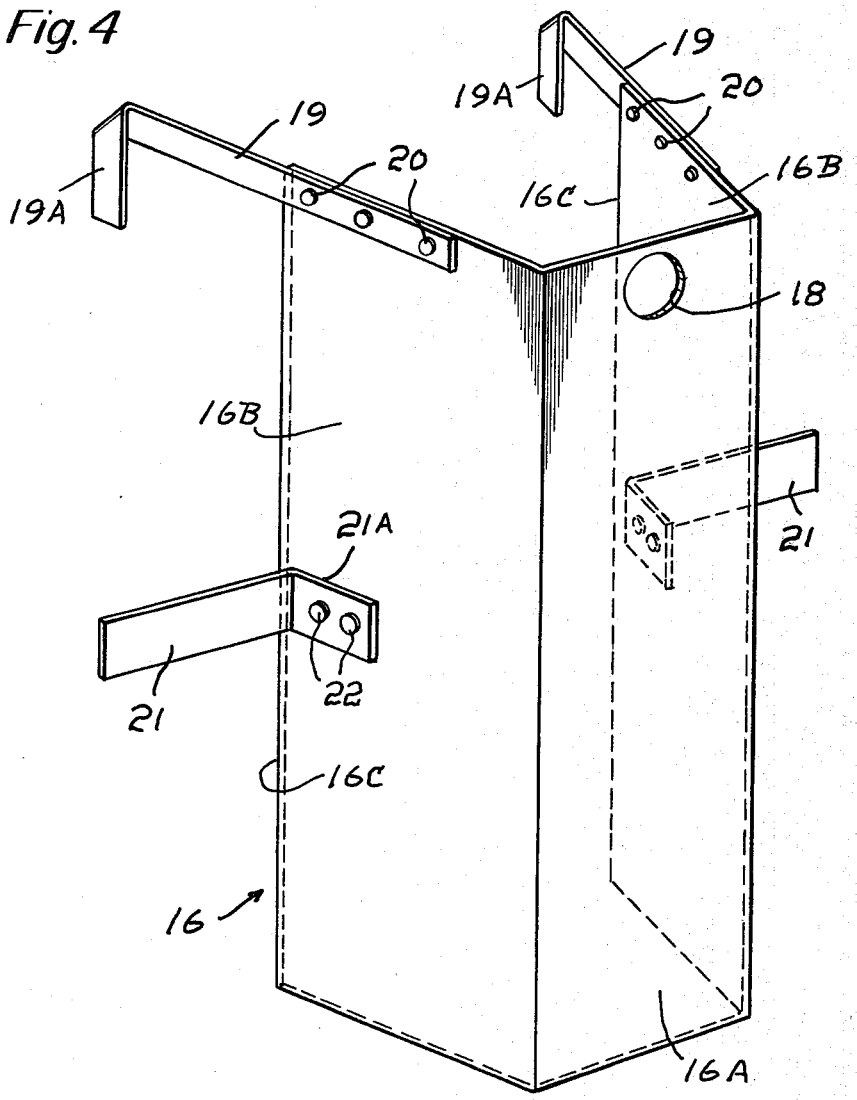
FIG. 4 is a perspective view of a baffle prior to its installation.

Each baffle side wall 16A is provided with a laterally projecting anchoring flange 21 positioned to be close to but below the tank port it is to shield. Each flange 21 has an angular section 21A secured as by non-corrosive rivets 20 to the appropriate side wall with the flange 20 spaced appreciably inwardly in the neighborhood of a quarter of an inch by way of example but not of limitation, of the side wall edge 16C. Each flange is of stock having sufficient resilience so that when seated against the side wall of the tank by a steel anchor 22, it is somewhat flexed, see FIG. 3, and resiliently maintains the edge 16C of the side wall to which it is attached tightly seated against the interior of the tank. While the flanges 20 may be of stainless steel, it is preferred that they be formed from a plastic with polycarbonate resins having proved to be satisfactory in use.

In practice, the stock from which the flanges 21 are formed is about an inch and a half in width and three inches in length.

In practice, mortar is applied to the top of the tank wall before the cover 11 is placed in position and this protects the hangers 19 from being materially distorted by the weight of the tank cover. In practice, the strips from which the hangers are formed are in the neighborhood of three-quarters of an inch in width thus to be embedded in the mortar.

Figure 5:
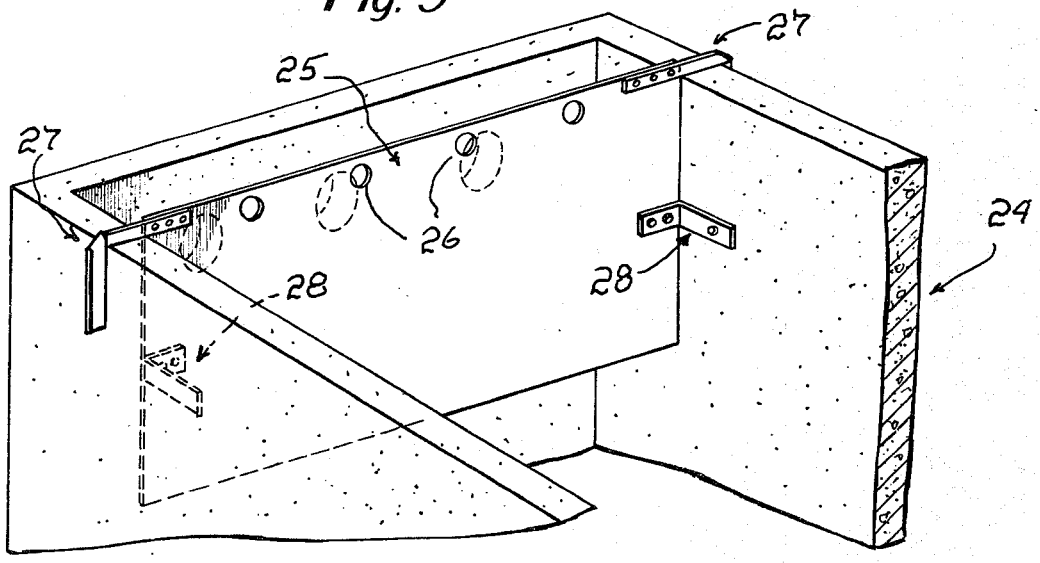
FIG. 5 is a perspective view of a baffle in accordance with another embodiment of the invention installed in an end of a rectangular septic tank.

In the case of rectangular tanks 24, see FIG. 5, having more than one port in each end, a baffle generally indicated at 25 may be used in place of individual baffles such as those previously described. The baffle 25 is a plastic sheet dimensioned to span the tank 24 with its edges 25A in contact with the side walls of the tank 24 and to extend downwardly into the tank as required by the tank depth and area.

Each baffle 25 has a transverse series of ports 26, hangers 27 at its upper ends that are or may be identical to the hangers 19, and flanges 28 attached to said ends to be below the ports of the tank 24 which are or may be identical to the anchoring flanges 21 and functioning in a manner resiliently opposing movement of the baffle edges 25A out of contact with the side walls of the tank 24.

I claim:

1. A baffle for septic tank inlet or outlet ports, said baffle of a plastic inert with respect to reagents normally found within a septic tank and dimensioned to extend downwardly from the top of the tank across and below the path of entering or exiting flows with side edges engageable with the interior of the tank to block lateral flow, means to anchor said baffle to the interior of the tank, said anchoring means including external anchoring flanges secured to the baffle at locations spaced a substantial distance inwardly from the side edges and between the ends thereof, each projecting laterally in a plane parallel to the appropriate one of said side edges, each anchoring flange of a material inert with respect to said reagents and that is resilient whereby when said flanges are brought into seated engagement with and anchored to the interior of the tank, the side edges of the baffle are in tight linear sealing engagement with said interior, and hangers, each attached to the upper edge of the baffle and including a hook portion extending beyond the appropriate one of the side edges of the baffle and shaped and dimensioned to fit over the upper end of the tank wall to hold the baffle in position while the flanges are being anchored against the interior surface of the tank wall.

2. The baffle of claim 1 in which the anchoring flanges are located close to but below the appropriate flow path.

3. The baffle of claim 1 in which the plastic of the baffle is polypropylene.

4. The baffle of claim 1 in which the anchoring flanges are of a non-fracturing plastic.

5. The baffle of claim 4 in which the anchoring flanges are of a polycarbonate resin.

6. The baffle of claim 1 in which the anchoring flanges are of stainless steel.

7. The baffle of claim 1 in which each hanger is a strip dimensioned to be embedded in the mortar that is to be between the tank wall and the tank cover and each hook includes a straight portion equal in length to the thickness of the tank wall and a straight end portion joined to the first named portion by a right angular fold.

8. The baffle of claim 7 in which each hanger is a strip of polypropylene.

9. The baffle of claim 1 in which the baffle is U-shaped in cross section and the flanges are secured to the side thereof.

10. The baffle of claim 1 for use with a rectangular tank having end ports, said baffle dimensioned to extend from side to side of the tank adjacent one end thereof with its side edges engaging the sides of the tank.

* * * * *